US011131487B2

(12) United States Patent
Yamashita

(10) Patent No.: US 11,131,487 B2
(45) Date of Patent: Sep. 28, 2021

(54) HEAT EXCHANGER, INDOOR UNIT OF AIR-CONDITIONING APPARATUS, AND AIR-CONDITIONING APPARATUS

(71) Applicant: Mitsubishi Electric Corporation, Tokyo (JP)

(72) Inventor: Yuya Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/619,622

(22) PCT Filed: Aug. 7, 2017

(86) PCT No.: PCT/JP2017/028540
§ 371 (c)(1),
(2) Date: Dec. 5, 2019

(87) PCT Pub. No.: WO2019/030793
PCT Pub. Date: Feb. 14, 2019

(65) Prior Publication Data
US 2020/0158387 A1 May 21, 2020

(51) Int. Cl.
*F28D 15/00* (2006.01)
*F25B 39/00* (2006.01)
(Continued)

(52) U.S. Cl.
CPC ..... *F25B 39/00* (2013.01); *F28F 1/32* (2013.01); *F24F 1/0059* (2013.01); *F24F 13/30* (2013.01);
(Continued)

(58) Field of Classification Search
CPC ..... F25B 39/00; F28F 1/32; F28F 9/02; F24F 1/0059; F24F 13/30; F28D 2021/0068
(Continued)

(56) References Cited

U.S. PATENT DOCUMENTS 5,482,115 A * 1/1996 Ikeya ..... B21D 53/08 165/151
5,937,668 A * 8/1999 Jun ..... F24F 1/0059 62/290
(Continued)

FOREIGN PATENT DOCUMENTS

CN 1228523 A 9/1999
CN 103791604 A 5/2014
(Continued)

OTHER PUBLICATIONS

Chinese Office Action dated Dec. 21, 2020, issued in corresponding CN Patent Application No. 201780093167.9 (and English Machine Translation).
(Continued)

*Primary Examiner* — Davis D Hwu
(74) *Attorney, Agent, or Firm* — Posz Law Group, PLC

(57) ABSTRACT

A heat exchanger includes a plurality of fins arranged in parallel, and a plurality of heat exchanger tubes penetrating the fins. The heat transfer tubes define a plurality of refrigerant passages through which refrigerant is passed inside the heat exchanger. Each of the refrigerant passages is formed as a single independent passage from the refrigerant inlet to the refrigerant outlet.

7 Claims, 5 Drawing Sheets

(51) Int. Cl.

| | |
|---|---|
| ***F28F 1/32*** | (2006.01) |
| *F24F 1/0059* | (2019.01) |
| *F24F 13/30* | (2006.01) |
| *F28D 21/00* | (2006.01) |
| *F28F 9/02* | (2006.01) |

(52) U.S. Cl.
CPC ..... *F28D 2021/0068* (2013.01); *F28F 9/02* (2013.01)

(58) Field of Classification Search
USPC ..... 165/104.21
See application file for complete search history.

(56) References Cited

U.S. PATENT DOCUMENTS

| | | | | |
|---|---|---|---|---|
| 5,983,998 | A | 11/1999 | Kim | |
| 6,378,605 | B1 * | 4/2002 | Kutscher | F28B 1/06 165/181 |
| 2012/0073786 | A1 | 3/2012 | Sakashita et al. | |
| 2015/0184951 | A1 * | 7/2015 | Lee | F28F 1/32 165/151 |

FOREIGN PATENT DOCUMENTS

| | | | |
|---|---|---|---|
| CN | 203940660 | U | 11/2014 |
| EP | 2 846 102 | A2 | 3/2015 |
| JP | H07-083458 | A | 3/1995 |
| JP | H11-287533 | A | 10/1999 |
| JP | 2001-215042 | A | 8/2001 |
| JP | 2014040983 | A | 3/2014 |
| JP | 2014-092295 | A | 5/2014 |
| JP | 2015-021676 | A | 2/2015 |
| WO | 2010/146852 | A1 | 12/2010 |

OTHER PUBLICATIONS

Office Action dated Sep. 29, 2020 issued in corresponding JP patent application No. 2019-536008 (and English Translation).
International Search Report of the International Searching Authority dated Sep. 26, 2017 for the corresponding International application No. PCT/JP2017/028540 (and English translation).
Chinese Office Action dated Jun. 16, 2021, issued in corresponding CN Patent Application No. 201780093167.9 (and English Machine Translation).

* cited by examiner

HEAT EXCHANGER, INDOOR UNIT OF AIR-CONDITIONING APPARATUS, AND AIR-CONDITIONING APPARATUS

CROSS REFERENCE TO RELATED APPLICATION

This application is a U.S. national stage application of PCT/JP2017/028540 filed on Aug. 7, 2017, the contents of which are incorporated herein by reference.

TECHNICAL FIELD

The present invention relates to a heat exchanger, an indoor unit of an air-conditioning apparatus, and an air-conditioning apparatus that include a plurality of refrigerant passages defined by a plurality of heat transfer tubes and through which refrigerant is passed inside the heat exchanger.

BACKGROUND ART

One common issue with indoor heat exchangers for use in air-conditioning apparatuses is that an attempt to operate such an indoor heat exchanger at higher output capacity results in greater pressure loss during cooling operation. Accordingly, to reduce pressure loss, the indoor heat exchanger is provided with a plurality of refrigerant passages, and the flow velocity through each refrigerant passage is lowered to reduce pressure loss.

For example, a heat exchanger has been proposed in which refrigerant is distributed by a distributor into six refrigerant passages at the refrigerant inlet of the heat exchanger, and each two of these refrigerant passages are combined together at an arbitrary point in the heat exchanger, resulting in three refrigerant passages formed at the refrigerant outlet of the heat exchanger (see, for example, Patent Literature 1).

CITATION LIST

Patent Literature

Patent Literature 1: Japanese Unexamined Patent Application Publication No. 2014-92295

SUMMARY OF INVENTION

Technical Problem

One issue with forming a plurality of refrigerant passages inside the heat exchanger is that, if the heat exchanger is of a chevron shape such as an inverted V, in particular, air passes through different areas inside the heat exchanger at different flow rates, resulting in different thermal loads for different areas. This makes it difficult to optimize thermal load balance to equalize thermal load in each of the refrigerant passages.

Further, to improve thermal load balance among the refrigerant passages, at least two refrigerant passages need to be combined into a single refrigerant passage at a point in the heat exchanger. In this case, if the pipe diameter remains the same before and after the combining of refrigerant passages, the flow velocity through the combined refrigerant passage increases, resulting in pressure loss.

The present invention has been made to address the above-mentioned problem, and accordingly it is an object of the invention to provide a heat exchanger, an indoor unit of an air-conditioning apparatus, and an air-conditioning apparatus that make it possible to improve thermal load balance and minimize pressure loss.

Solution to Problem

A heat exchanger according to an embodiment of the present invention includes a plurality of fins arranged in parallel, and a plurality of heat exchanger tubes that penetrate the fins. The heat transfer tubes define a plurality of refrigerant passages through which refrigerant is passed inside the heat exchanger. Each of the refrigerant passages is formed as a single independent passage from the refrigerant inlet to the refrigerant outlet.

An indoor unit of an air-conditioning apparatus according to an embodiment of the present invention includes the heat exchanger mentioned above.

An air-conditioning apparatus according to an embodiment of the present invention includes the indoor unit of an air-conditioning apparatus mentioned above.

Advantageous Effects of Invention

With the heat exchanger, the indoor unit of an air-conditioning apparatus, and the air-conditioning apparatus according to an embodiment of the present invention, each of the refrigerant passages is formed as a single independent passage from the refrigerant inlet to the refrigerant outlet of the heat exchanger. Therefore, improved thermal load balance can be obtained, and pressure loss can be minimized.

DESCRIPTION OF EMBODIMENTS

Figure 1:
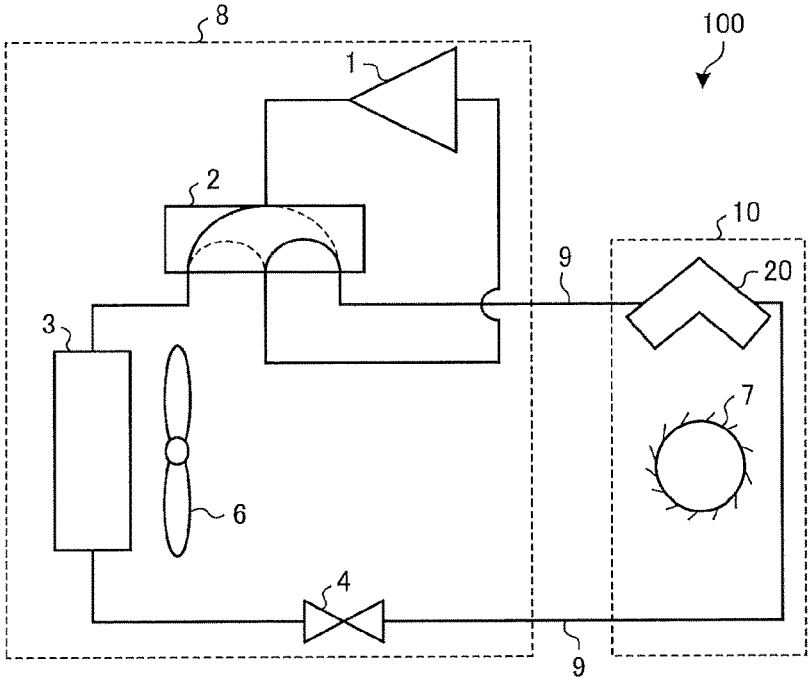
FIG. 1 is a schematic diagram illustrating an air-conditioning apparatus according to Embodiment 1 of the present invention.

Embodiments of the present invention will be described below with reference to the drawings. Elements designated by the same reference signs in the drawings represent the same or corresponding elements throughout the specification. Further, the specific forms or implementations of components described throughout the specification are intended to be illustrative only and not restrictive.

Embodiment 1

<Configuration of Air-Conditioning Apparatus 100>

FIG. 1 is a schematic diagram illustrating an air-conditioning apparatus 100 according to Embodiment 1 of the present invention. As illustrated in FIG. 1, the air-conditioning apparatus 100 includes an outdoor unit 8 and an indoor unit 10 that are connected by a refrigerant pipe 9.

The refrigerant pipe 9, which connects the outdoor unit 8 with the indoor unit 10, is filled with refrigerant used for exchange of heat. The refrigerant circulates between the outdoor unit 8 and the indoor unit 10 to cool or heat a space where the indoor unit 10 is placed. The refrigerant used may be, for example, R32 or R410A.

The outdoor unit 8 includes a compressor 1, an outdoor heat exchanger 3, an expansion valve 4, a four-way valve 2, and an outdoor fan 6. The indoor unit 10 includes an indoor heat exchanger 20, which is a heat exchanger according to the present invention, and a cross-flow fan 7, which is an indoor fan.

<Configuration of Indoor Unit 10 of Air-Conditioning Apparatus 100>

Figure 2:
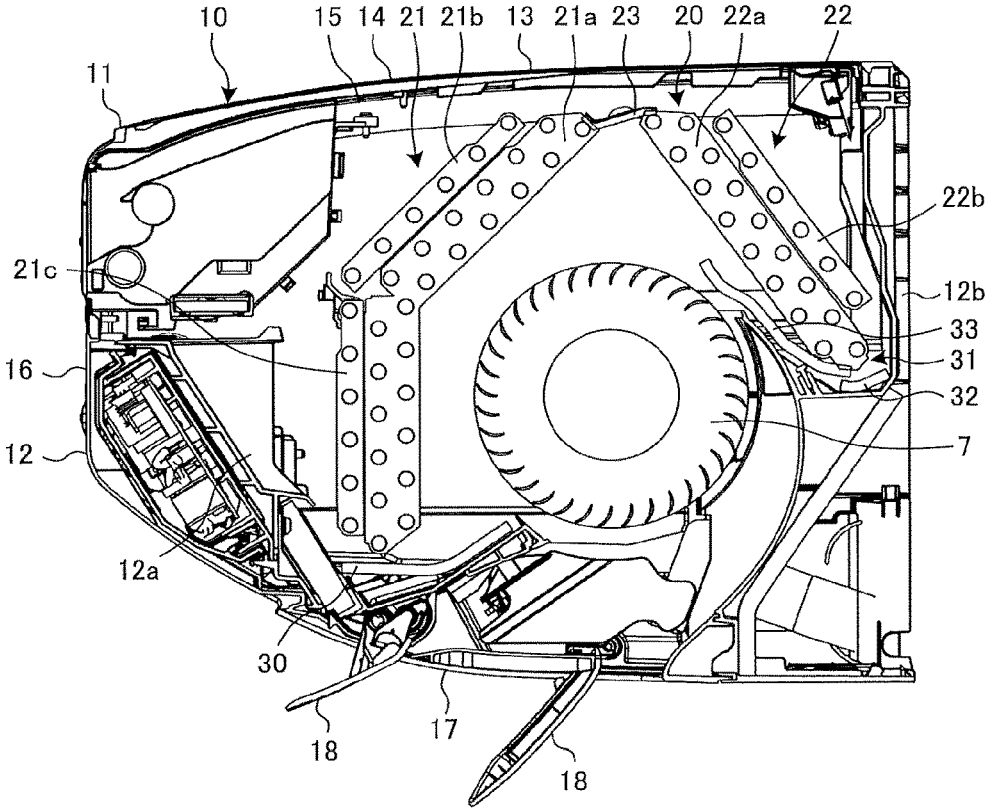
FIG. 2 illustrates a longitudinal section of an indoor unit of an air-conditioning apparatus according to Embodiment 1 of the present invention.

FIG. 2 illustrates a longitudinal section of the indoor unit 10 of the air-conditioning apparatus 100 according to Embodiment 1 of the present invention. The longitudinal section of FIG. 2 is not hatched in view of the complicated arrangements of components depicted in FIG. 2.

As illustrated in FIG. 2, a housing 11 of the indoor unit 10 is formed by a design panel 12 having a rectangular sectional shape. An air inlet 13 is provided in an upper portion of the design panel 12. The air inlet 13 is provided with a top grating 14. The top grating 14 is provided with an air filter 15 attached on the inside of the housing 11. The front of the design panel 12 forms a front panel 16. An air outlet 17 is provided in a lower portion of the design panel 12. An up/down deflector 18 and a left/right deflector (not illustrated) are provided at the air outlet 17. A front casing 12*a* is disposed inside the design panel 12. A lower rear portion of the design panel 12 is connected to a rear casing 12*b*.

The indoor heat exchanger 20 is placed so as to face the front panel 16. The indoor heat exchanger 20 includes a front heat-exchange unit 21, which directly faces the front panel 16, and a rear heat-exchange unit 22, which is disposed rearward of the front heat-exchange unit 21. In the space between the front heat-exchange unit 21 and the rear heat-exchange unit 22, a partition plate 23 is provided to prevent intrusion of airflow.

The indoor heat exchanger 20 is formed in a chevron shape with an outer periphery portion and an inner periphery portion. The outer periphery portion is located in an upper portion of the housing 11 and on the upwind side of the front and rear faces of the indoor heat exchanger 20. The inner periphery portion is located on the downwind side in a lower portion of the housing 11. The indoor heat exchanger 20 includes three rows of heat transfer tubes 25 disposed between the outer periphery portion and the inner periphery portion to allow heat exchange. The indoor heat exchanger 20 may include four or more rows of heat transfer tubes 25 disposed between the outer periphery portion and the inner periphery portion to allow heat exchange.

The front heat-exchange unit 21 includes a main front heat-exchange unit 21*a*, and two auxiliary front heat-exchange units 21*b* and 21*c* positioned upwind of the main front heat-exchange unit 21*a*. The main front heat-exchange unit 21*a* is bent in a middle portion relative to the vertical direction. The main front heat-exchange unit 21*a* includes two rows of heat transfer tubes 25. The main front heat-exchange unit 21*a* may include two or more rows of heat transfer tubes 25. The two auxiliary front heat-exchange units 21*b* and 21*c* are each disposed beside upper and lower portions of the bent main front heat-exchange unit 21*a*. Each of the two auxiliary front heat-exchange units 21*b* and 21*c* includes one row of heat transfer tubes 25. Each of the two auxiliary front heat-exchange units 21*b* and 21*c* may include one or more rows of heat transfer tubes 25. The main front heat-exchange unit 21*a*, and each of the two auxiliary front heat-exchange units 21*b* and 21*c* are spaced apart from each other.

The rear heat-exchange unit 22 includes a main rear heat-exchange unit 22*a*, and an auxiliary rear heat-exchange unit 22*b* positioned upwind of the main rear heat-exchange unit 22*a*. The main rear heat-exchange unit 22*a* includes two rows of heat transfer tubes 25. The main rear heat-exchange unit 22*a* may include two or more rows of heat transfer tubes 25. The auxiliary rear heat-exchange unit 22*b* includes one row of heat transfer tubes 25. The auxiliary rear heat-exchange unit 22*b* may include one or more rows of heat transfer tubes 25. The main rear heat-exchange unit 22*a* and the auxiliary rear heat-exchange unit 22*b* are spaced apart from each other.

The cross-flow fan 7 is disposed on the downwind side beside the inner periphery portion of the indoor heat exchanger 20 having a chevron shape. The cross-flow fan 7 has a cylindrical shape, with a plurality of air-sending blades provided on its outer periphery portion.

A drain pan 30 is provided in a front end portion of the indoor heat exchanger 20 to store the condensed water from the front heat-exchange unit 21. The drain pan 30 does not divide the space between the front heat-exchange unit 21 and the cross-flow fan 7.

A partition unit 31 is provided in a rear end portion of the indoor heat exchanger 20 to provide separation from a downwind area where the cross-flow fan 7 is disposed. The partition unit 31 includes a drain pan 32 to store the condensed water from the rear heat-exchange unit 22 as drain water, and a partition plate 33 inserted from the drain pan 32 into the space between the rear heat-exchange unit 22 and the cross-flow fan 7. The partition unit 31 may be formed by, other than using the partition plate 33, extending the rear casing 12*b* or the drain pan 32. Due to the presence of the partition unit 31 in the indoor heat exchanger 20, the rate of airflow through the front heat-exchange unit 21 is higher than the rate of airflow through the rear heat-exchange unit 22.

<Configuration of Refrigerant Passages 40*a*, 40*b*, 40*c*, and 40*d*>

Figure 3:
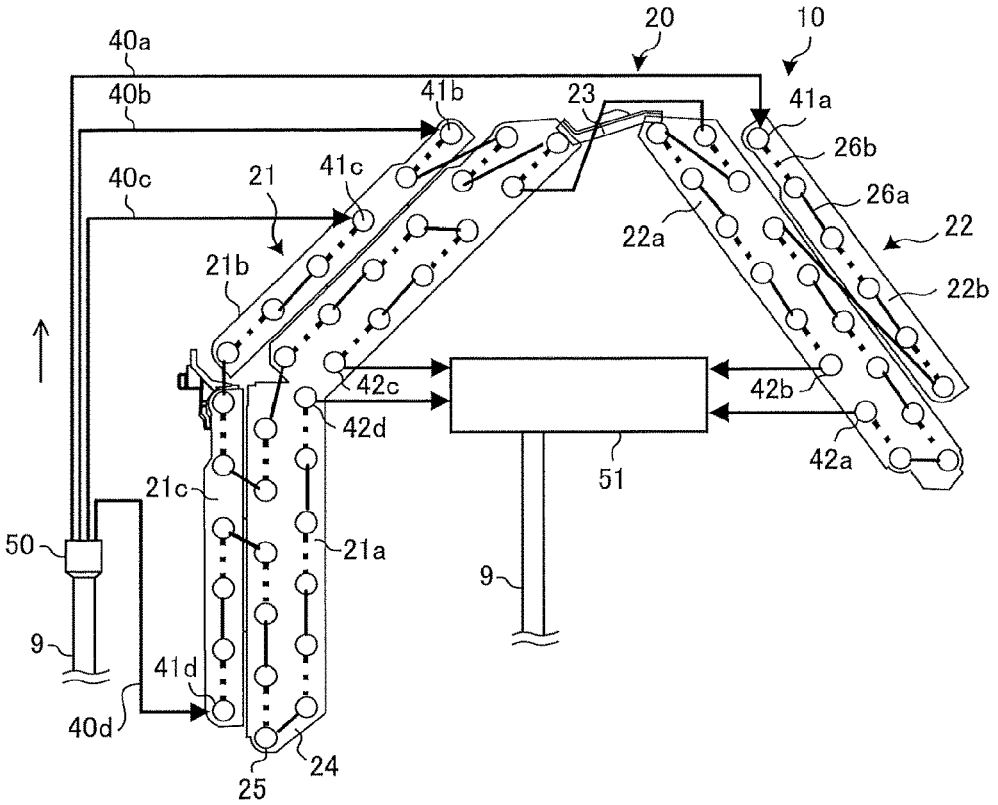
FIG. 3 illustrates four refrigerant passages in an indoor heat exchanger during cooling operation according to Embodiment 1 of the present invention.

FIG. 3 illustrates four refrigerant passages 40*a*, 40*b*, 40*c*, and 40*d* in the indoor heat exchanger 20 during cooling operation according to Embodiment 1 of the present invention.

The indoor heat exchanger 20 includes a plurality of fins 24 arranged in parallel. The fins 24 are arranged in parallel to each other with a small gap therebetween, and in parallel to the flow of air. The fins 24 have a rectangular shape. The indoor heat exchanger 20 includes a plurality of heat transfer tubes 25 penetrating the fins 24. In FIG. 3, each heat transfer tube 25 extends toward the near side and the far side of FIG. 3.

As illustrated in FIG. 3, the indoor unit 10 includes a distributor 50 to distribute refrigerant from a single refrigerant pipe 9 into respective refrigerant inlets 41*a*, 41*b*, 41*c*, and 41*d* of the four refrigerant passages 40*a*, 40*b*, 40*c*, and 40*d*. The indoor unit 10 includes a combining unit 51 to combine refrigerant streams from respective refrigerant outlets 42*a*, 42*b*, 42*c*, and 42*d* of the four refrigerant passages 40*a*, 40*b*, 40*c*, and 40*d* into the single refrigerant pipe 9.

As indicated by arrows in FIG. 3, the heat transfer tubes 25 define the four refrigerant passages 40*a*, 40*b*, 40*c*, and 40*d* through which refrigerant is passed inside the indoor heat exchanger 20. The number of refrigerant passages may be two or more, more preferably four or more. For each of the four refrigerant passages 40*a*, 40*b*, 40*c*, and 40*d*, the corresponding refrigerant inlet 41*a*, 41*b*, 41*c*, or 41*d* is provided in the auxiliary front heat-exchange unit 21*b* or 21*c* or in the auxiliary rear heat-exchange unit 22*b*.

Each of the four refrigerant passages 40*a*, 40*b*, 40*c*, and 40*d* is formed as a path extending between the outer and inner periphery portions of the indoor heat exchanger 20. More specifically, the direction of refrigerant flow during cooling operation is such that in each of the four refrigerant passages 40*a*, 40*b*, 40*c*, and 40*d* into which refrigerant is distributed by the distributor 50, refrigerant enters from the corresponding refrigerant inlet 41*a*, 41*b*, 41*c*, or 41*d* provided in the auxiliary front heat-exchange unit 21*b* or 21*c* of the indoor heat exchanger 20 or in the auxiliary rear heat-exchange unit 22*b* of the indoor heat exchanger 20. Each of the four refrigerant passages 40*a*, 40*b*, 40*c*, and 40*d* is formed by connecting at least two heat transfer tubes 25 in the auxiliary front heat-exchange unit 21*b* or 21*c* or in the auxiliary rear heat-exchange unit 22*b*. Two adjacent two heat transfer tubes 25 are connected by a U-tube 26*a* provided in the indoor heat exchanger 20. The U-tube 26*a* indicated by a solid line in FIG. 3, which connects two adjacent heat transfer tubes 25, is shown on the near side of FIG. 3. The heat transfer tube 25 has a fold-back portion 26*b* indicated by a dashed line in FIG. 3 and is shown on the far side of FIG. 3. Further, each of the four refrigerant passages 40*a*, 40*b*, 40*c*, and 40*d* is formed by connecting at least two heat transfer tubes 25 in each of two tube rows in the main front heat-exchange unit 21*a* or the main rear heat-exchange unit 22*a*. Two adjacent heat transfer tubes 25 are connected by the U-tube 26*a* provided in the indoor heat exchanger 20. Then, each of the four refrigerant passages 40*a*, 40*b*, 40*c*, and 40*d* allows refrigerant to exit into the combining unit 51 from the corresponding refrigerant outlet 42*a*, 42*b*, 42*c*, or 42*d*, which is provided in the main front heat-exchange unit 21*a* or the main rear heat-exchange unit 22*a* of the indoor heat exchanger 20. The direction of refrigerant flow during heating operation is opposite to the direction of refrigerant flow during cooling operation. As described above, each of the four refrigerant passages 40*a*, 40*b*, 40*c*, and 40*d* is formed by connecting two or more heat transfer tubes 25 in each tube row of the indoor heat exchanger 20. At this time, each of the four refrigerant passages 40*a*, 40*b*, 40*c*, and 40*d* neither combines with another passage nor splits into branches at any point along the path from the distributor 50 to the combining unit 51. In other words, each of the four refrigerant passages 40*a*, 40*b*, 40*c*, and 40*d* is formed as a single independent passage from the corresponding refrigerant inlet 41*a*, 41*b*, 41*c*, or 41*d* to the corresponding refrigerant outlet 42*a*, 42*b*, 42*c*, or 42*d* of the indoor heat exchanger 20.

<Configuration of Refrigerant Passages 40*a*, 40*b*, 40*c*, 40*d*, 40*e*, and 40*f* according to Modification of Embodiment 1>

Figure 4:
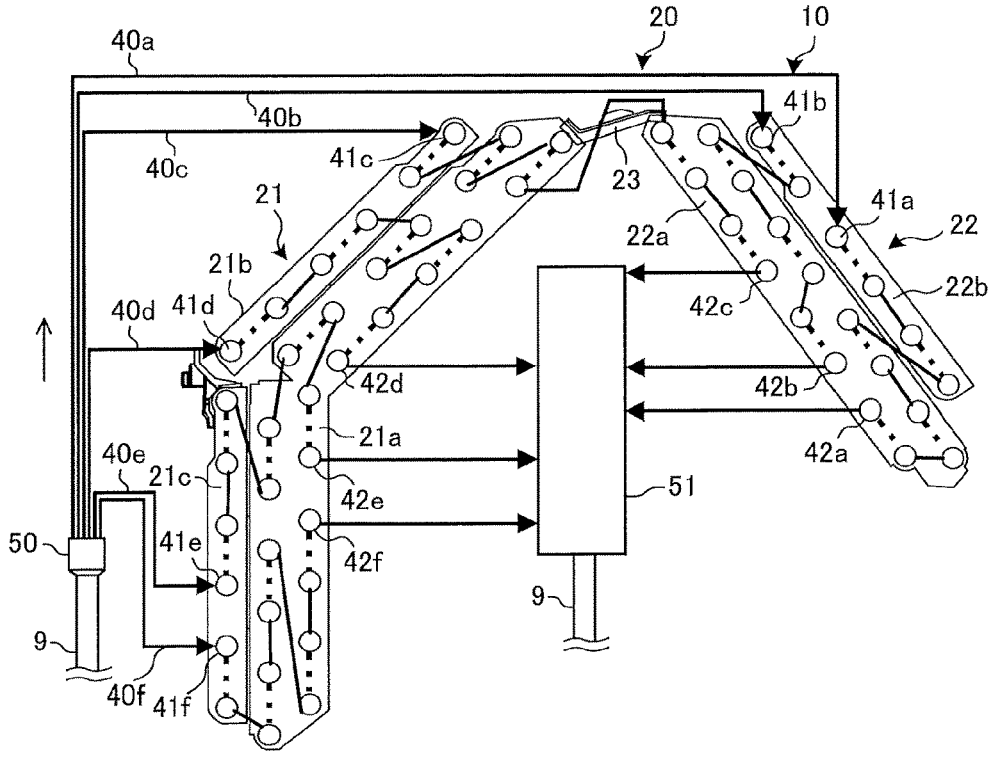
FIG. 4 illustrates six refrigerant passages in the indoor heat exchanger during cooling operation according to a modification of Embodiment 1 of the present invention.

FIG. 4 illustrates six refrigerant passages 40*a*, 40*b*, 40*c*, 40*d*, 40*e*, and 40*f* in the indoor heat exchanger 20 during cooling operation according to a modification of Embodiment 1 of the present invention. Only characteristic features of the modification of Embodiment 1 will be described below, and features similar to those of Embodiment 1 described above will not be described in further detail.

FIG. 4 depicts six refrigerant passages 40*a*, 40*b*, 40*c*, 40*d*, 40*e*, and 40*f*. In this case, each of the six refrigerant passages 40*a*, 40*b*, 40*c*, 40*d*, 40*e*, and 40*f* neither combines with another passage nor splits into branches at any point along the path from the distributor 50 to the combining unit 51. In other words, each of the six refrigerant passages 40*a*, 40*b*, 40*c*, 40*d*, 40*e*, and 40*f* is formed as a single independent passage from the corresponding refrigerant inlet 41*a*, 41*b*, 41*c*, 41*d*, 41*e*, or 41*f* to the corresponding refrigerant outlet 42*a*, 42*b*, 42*c*, 42*d*, 42*e*, or 42*f* of the indoor heat exchanger 20.

It is to be noted that the same advantageous effects of the present invention as mentioned above can be obtained also for cases where refrigerant is distributed into a number N of refrigerant passages greater than or equal to four as with this modification.

<Advantageous Effects of Embodiment 1>

According to Embodiment 1, the indoor heat exchanger 20 includes the fins 24 arranged in parallel. The indoor heat exchanger 20 includes the heat transfer tubes 25 penetrating the fins 24. The heat transfer tubes 25 define the refrigerant passages 40*a*, 40*b*, 40*c*, 40*d*, 40*e*, and 40*f* through which refrigerant is passed inside the indoor heat exchanger 20. Each of the refrigerant passages 40*a*, 40*b*, 40*c*, 40*d*, 40*e*, and 40*f* is formed as a single independent passage from the corresponding refrigerant inlet 41*a*, 41*b*, 41*c*, 41*d*, 41*e*, or 41*f* to the corresponding refrigerant outlet 42*a*, 42*b*, 42*c*, 42*d*, 42*e*, or 42*f* of the indoor heat exchanger 20.

With the above-mentioned configuration, each of the refrigerant passages 40*a*, 40*b*, 40*c*, 40*d*, 40*e*, and 40*f* is formed as a single independent passage from the corresponding refrigerant inlet 41*a*, 41*b*, 41*c*, 41*d*, 41*e*, or 41*f* to the corresponding refrigerant outlet 42*a*, 42*b*, 42*c*, 42*d*, 42*e*, or 42*f* of the indoor heat exchanger 20, without neither combining with another passage nor splitting into branches at any point. Consequently, even if thermal load varies with location inside the indoor heat exchanger 20, the path lengths of the individual refrigerant passages 40*a*, 40*b*, 40*c*, 40*d*, 40*e*, and 40*f* can be set so as to equalize thermal load in each refrigerant passage, thus allowing for improved thermal load balance. Further, each of the refrigerant passages 40*a*, 40*b*, 40*c*, 40*d*, 40*e*, and 40*f* does not combine with another passage at any point, and thus pressure loss can be minimized.

According to Embodiment 1, the indoor heat exchanger 20 is in a chevron shape whose outer periphery portion is located on the upwind side and whose inner periphery portion is located on the downwind side. Each of the refrigerant passages 40*a*, 40*b*, 40*c*, 40*d*, 40*e*, and 40*f* is formed as a path extending between the outer and inner periphery portions of the indoor heat exchanger 20.

With the above-mentioned configuration, the heat transfer tubes 25 in each of the refrigerant passages 40*a*, 40*b*, 40*c*, 40*d*, 40*e*, and 40*f* allow refrigerant to flow in a direction orthogonal to the direction of airflow. This leads to increased chances of heat exchange for the refrigerant flowing through the indoor heat exchanger 20, and consequently enhanced efficiency of heat exchange.

According to Embodiment 1, the indoor heat exchanger 20 includes three or more rows of heat transfer tubes 25 disposed between the outer and inner periphery portions of the indoor heat exchanger 20 to allow heat exchange. Each of the refrigerant passages 40*a*, 40*b*, 40*c*, 40*d*, 40*e*, and 40*f* is formed by connecting two or more heat transfer tubes 25 in each tube row of the indoor heat exchanger 20.

With the above-mentioned configuration, each of the refrigerant passages 40*a*, 40*b*, 40*c*, 40*d*, 40*e*, and 40*f* passes through two or more heat transfer tubes 25 in each tube row of the indoor heat exchanger 20. This increases the chances of heat exchange in each tube row for the refrigerant flowing through the indoor heat exchanger 20, leading to enhanced efficiency of heat exchange.

According to Embodiment 1, the number of refrigerant passages 40*a*, 40*b*, 40*c*, 40*d*, 40*e*, and 40*f* is greater than or equal to four.

This configuration ensures that even if, for reasons such as the indoor heat exchanger 20 having an enlarged size, thermal load varies greatly with specific location inside the indoor heat exchanger 20 due to an imbalance in the rate of airflow through such location, improved thermal load balance can be obtained to equalize thermal load in each of the four or more refrigerant passages 40*a*, 40*b*, 40*c*, 40*d*, 40*e*, and 40*f*.

According to Embodiment 1, the indoor unit 10 of the air-conditioning apparatus 100 includes the indoor heat exchanger 20.

With the above-mentioned configuration, for the indoor heat exchanger 20 mounted in the indoor unit 10 of the air-conditioning apparatus 100, improved thermal load balance can be provided, and thus pressure loss can be minimized.

According to Embodiment 1, the indoor unit 10 of the air-conditioning apparatus 100 includes the distributor 50 to distribute refrigerant from a single refrigerant pipe 9 into the respective refrigerant inlets 41*a*, 41*b*, 41*c*, 41*d*, 41*e*, and 41*f* of the refrigerant passages 40*a*, 40*b*, 40*c*, 40*d*, 40*e*, and 40*f*. The indoor unit 10 of the air-conditioning apparatus 100 includes the combining unit 51 to combine refrigerant streams from the respective refrigerant outlets 42*a*, 42*b*, 42*c*, 42*d*, 42*e*, and 42*f* of the refrigerant passages 40*a*, 40*b*, 40*c*, 40*d*, 40*e*, and 40*f* into the single refrigerant pipe 9.

With the above-mentioned configuration, refrigerant from the single refrigerant pipe 9 is split by the distributor 50 into separate refrigerant streams, which are then passed through the indoor heat exchanger 20 that allows for improved thermal load balance and minimized pressure loss, and subsequently combined together by the combining unit 51 into the single refrigerant pipe 9.

According to Embodiment 1, the air-conditioning apparatus 100 includes the indoor unit 10 of the air-conditioning apparatus 100.

With the above-mentioned configuration, for the indoor heat exchanger 20 mounted in the indoor unit 10 of the air-conditioning apparatus 100 in the air-conditioning apparatus 100, improved thermal load balance can be provided, and thus pressure loss can be minimized.

Embodiment 2

<Configuration of Refrigerant Passages 40*a*, 40*b*, 40*c*, and 40*d*>

Figure 5:
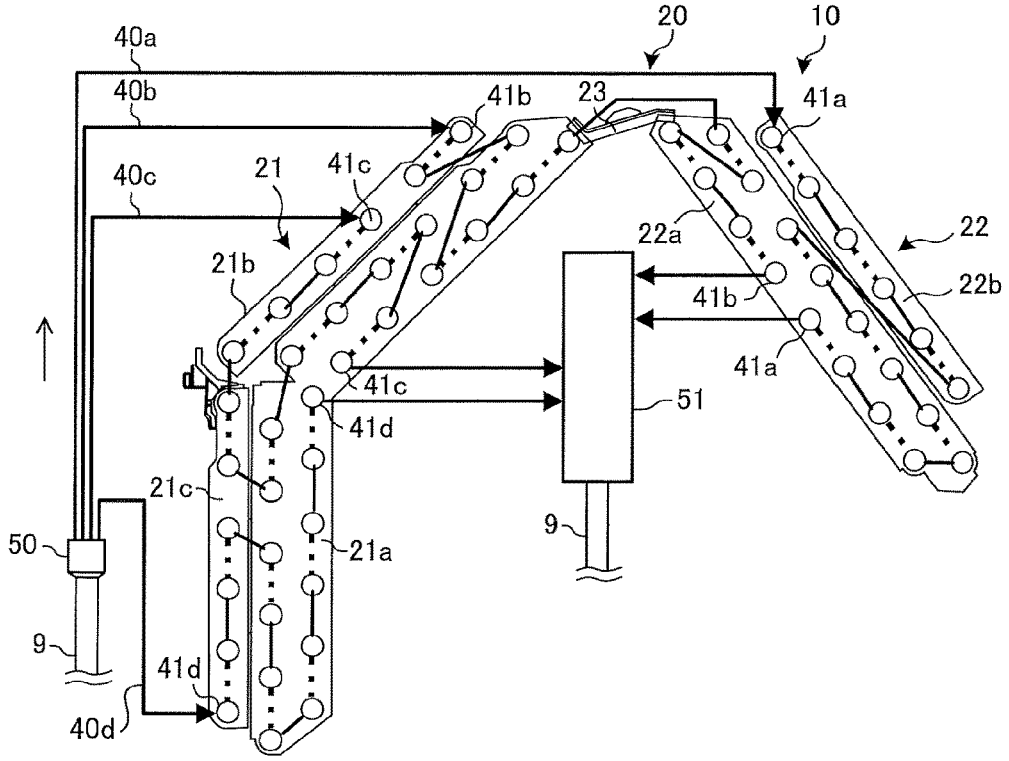
FIG. 5 illustrates four refrigerant passages in the indoor heat exchanger during cooling operation according to Embodiment 2 of the present invention.

FIG. 5 illustrates four refrigerant passages 40*a*, 40*b*, 40*c*, and 40*d* in the indoor heat exchanger 20 during cooling operation according to Embodiment 2 of the present invention. Only characteristic features of Embodiment 2 will be described below, and features similar to those of Embodiment 1 described above will not be described in further detail.

As illustrated in FIG. 5, of the four refrigerant passages 40*a*, 40*b*, 40*c*, and 40*d*, the refrigerant passage 40*a*, which is located in an area where the rate of airflow through the indoor heat exchanger 20 is lowest, has a greater path length than the other refrigerant passages 40*b*, 40*c*, and 40*d*. Each of the four refrigerant passages 40*a*, 40*b*, 40*c*, and 40*d* neither combines with another passage nor splits into branches at any point along the path from the distributor 50 to the combining unit 51. In other words, each of the four refrigerant passages 40*a*, 40*b*, 40*c*, and 40*d* is formed as a single independent passage from the corresponding refrigerant inlet 41*a*, 41*b*, 41*c*, or 41*d* to the corresponding refrigerant outlet 42*a*, 42*b*, 42*c*, or 42*d* of the indoor heat exchanger 20.

More specifically, the refrigerant passage 40*a* is formed by connecting eight heat transfer tubes 25. The refrigerant passage 40*b* is formed by connecting seven heat transfer tubes 25. The refrigerant passage 40*c* is formed by connecting seven heat transfer tubes 25. The refrigerant passage 40*d* is formed by connecting seven heat transfer tubes 25. The refrigerant passage 40*a* thus has a greater path length than the other refrigerant passages 40*b*, 40*c*, and 40*d*.

<Air Velocity Distribution in Indoor Heat Exchanger 20>

Figure 6:
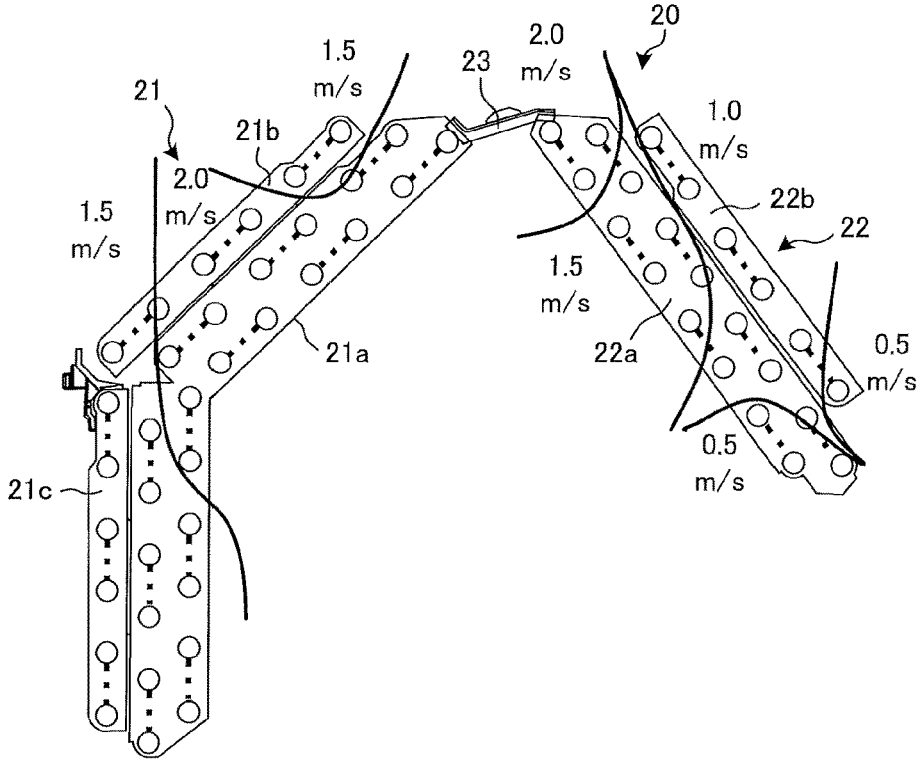
FIG. 6 illustrates the distribution of air velocity in the indoor heat exchanger according to Embodiment 2 of the present invention.

FIG. 6 illustrates the distribution of air velocity in the indoor heat exchanger 20 according to Embodiment 2 of the present invention. Numerical values in FIG. 6 represent rates at which air flows for a given fan airflow rate. It is appreciated from FIG. 6 that the airflow rate is relatively low in the vicinity of the lowermost end portion of the rear heat-exchange unit 22 in comparison to other areas in the indoor heat exchanger 20.

The reason for the relatively low airflow rate is that in the vicinity of the lowermost end portion of the rear heat-exchange unit 22, the flow of air through the indoor heat exchanger 20 is diverted in a U-turn manner by the partition unit 31, causing the airflow rate to become lowest in this area. Accordingly, the refrigerant passage 40*a* with increased path length is disposed in the area where the flow of air through the indoor heat exchanger 20 is diverted around by the partition unit 31 and is at its lowest flow rate.

<Configuration of Refrigerant Passages 40*a*, 40*b*, 40*c*, 40*d*, 40*e*, and 40*f* according to Modification of Embodiment 2>

Figure 7:
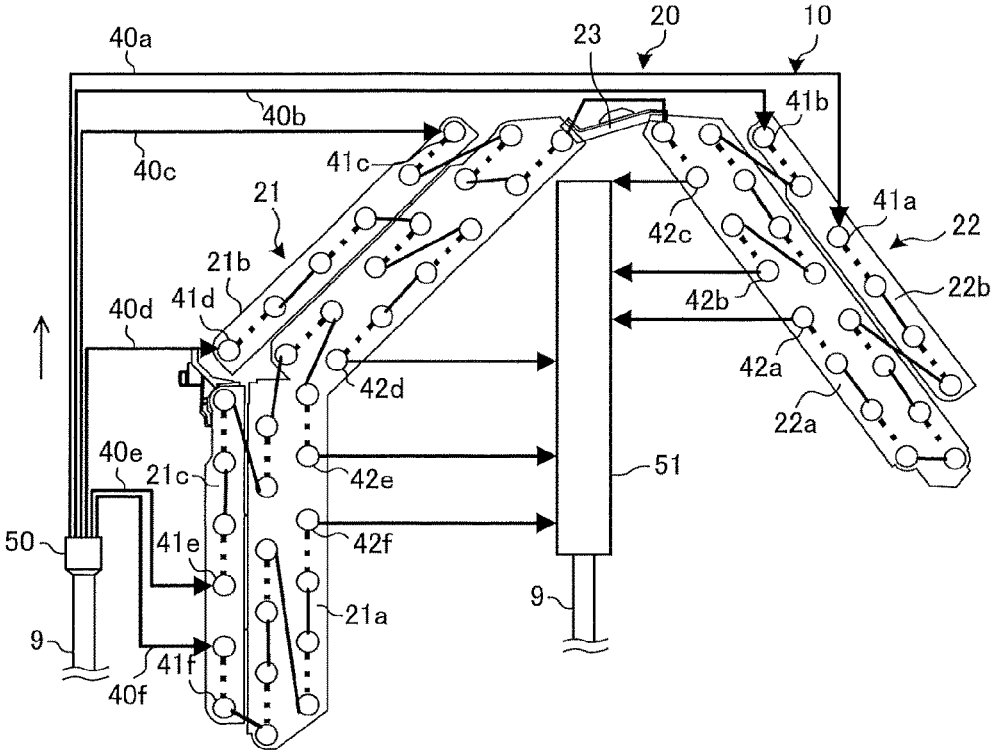
FIG. 7 illustrates six refrigerant passages in the indoor heat exchanger during cooling operation according to a modification of Embodiment 2 of the present invention.

FIG. 7 illustrates six refrigerant passages 40*a*, 40*b*, 40*c*, 40*d*, 40*e*, and 40*f* in the indoor heat exchanger 20 during cooling operation according to a modification of Embodiment 2 of the present invention. Only characteristic features of the modification of Embodiment 2 will be described below, and features similar to those of Embodiment 2 described above will not be described in further detail.

FIG. 7 depicts six refrigerant passages 40*a*, 40*b*, 40*c*, 40*d*, 40*e*, and 40*f*. Of the six refrigerant passages 40*a*, 40*b*, 40*c*, 40*d*, 40*e*, and 40*f*, the refrigerant passage 40*a*, which is located in an area where the rate of airflow through the indoor heat exchanger 20 is lowest, has a greater path length than the other refrigerant passages 40*b*, 40*c*, 40*d*, 40*e*, and 40*f*. Each of the six refrigerant passages 40*a*, 40*b*, 40*c*, 40*d*, 40*e*, and 40*f* neither combines with another passage nor splits into branches at any point along the path from the distributor 50 to the combining unit 51. In other words, each of the six refrigerant passages 40*a*, 40*b*, 40*c*, 40*d*, 40*e*, and 40*f* is formed as a single independent passage from the corresponding refrigerant inlet 41*a*, 41*b*, 41*c*, 41*d*, 41*e*, or 41*f* to the corresponding refrigerant outlet 42*a*, 42*b*, 42*c*, 42*d*, 42*e*, or 42*f* of the indoor heat exchanger 20.

More specifically, the refrigerant passage 40*a* is formed by connecting six heat transfer tubes 25. The refrigerant passage 40*b* is formed by connecting four heat transfer tubes 25. The refrigerant passage 40*c* is formed by connecting four heat transfer tubes 25. The refrigerant passage 40*d* is formed by connecting five heat transfer tubes 25. The refrigerant passage 40*e* is formed by connecting five heat transfer tubes 25. The refrigerant passage 40*f* is formed by connecting five heat transfer tubes 25. The refrigerant passage 40*a* thus has a greater path length than the other refrigerant passages 40*b*, 40*c*, 40*d*, 40*e*, and 40*f*.

It is to be noted that the same advantageous effects of the present invention as mentioned above can be obtained also for cases where refrigerant is distributed into a number N of refrigerant passages greater than or equal to four as with this modification.

<Advantageous Effects of Embodiment 2>

According to Embodiment 2, of the refrigerant passages 40*a*, 40*b*, 40*c*, 40*d*, 40*e*, and 40*f*, the refrigerant passage 40*a*, which is located in an area where the rate of airflow through the indoor heat exchanger 20 is lowest, has a greater path length than the other refrigerant passages 40*b*, 40*c*, 40*d*, 40*e*, and 40*f*.

With the above-mentioned configuration, the refrigerant passage 40*a*, which is located in an area where the rate of airflow through the indoor heat exchanger 20 is lowest, has a greater path length than the other refrigerant passages 40*b*, 40*c*, 40*d*, 40*e*, and 40*f*. This leads to increased chances of heat exchange despite low thermal load in the area. Therefore, the path lengths of the individual refrigerant passages 40*a*, 40*b*, 40*c*, 40*d*, 40*e*, and 40*f* can be set so as to equalize thermal load in each refrigerant passage, thus allowing for improved thermal load balance.

According to Embodiment 2, the partition unit 31 is provided in an end portion of the indoor heat exchanger 20 to separate the end portion from an area positioned downwind of the end portion. The refrigerant passage 40*a* with increased path length is disposed in an area where the flow of air through the indoor heat exchanger 20 is diverted around by the partition unit 31 and is at its lowest flow rate.

With the above-mentioned configuration, the refrigerant passage 40*a* with increased path length is disposed in the area where the flow of air through the indoor heat exchanger 20 is diverted around by the partition unit 31 and is at its lowest flow rate. In this regard, thermal load is low in the area of lowest airflow rate. However, the increased path length of the refrigerant passage 40*a* ensures increased chances of heat exchange. Therefore, the path lengths of the individual refrigerant passages 40*a*, 40*b*, 40*c*, 40*d*, 40*e*, and 40*f* can be set so as to equalize thermal load in each refrigerant passage, thus allowing for improved thermal load balance.

Embodiment 3

<Configuration of Refrigerant Passages 40*a*, 40*b*, 40*c*, and 40*d*>

Figure 8:
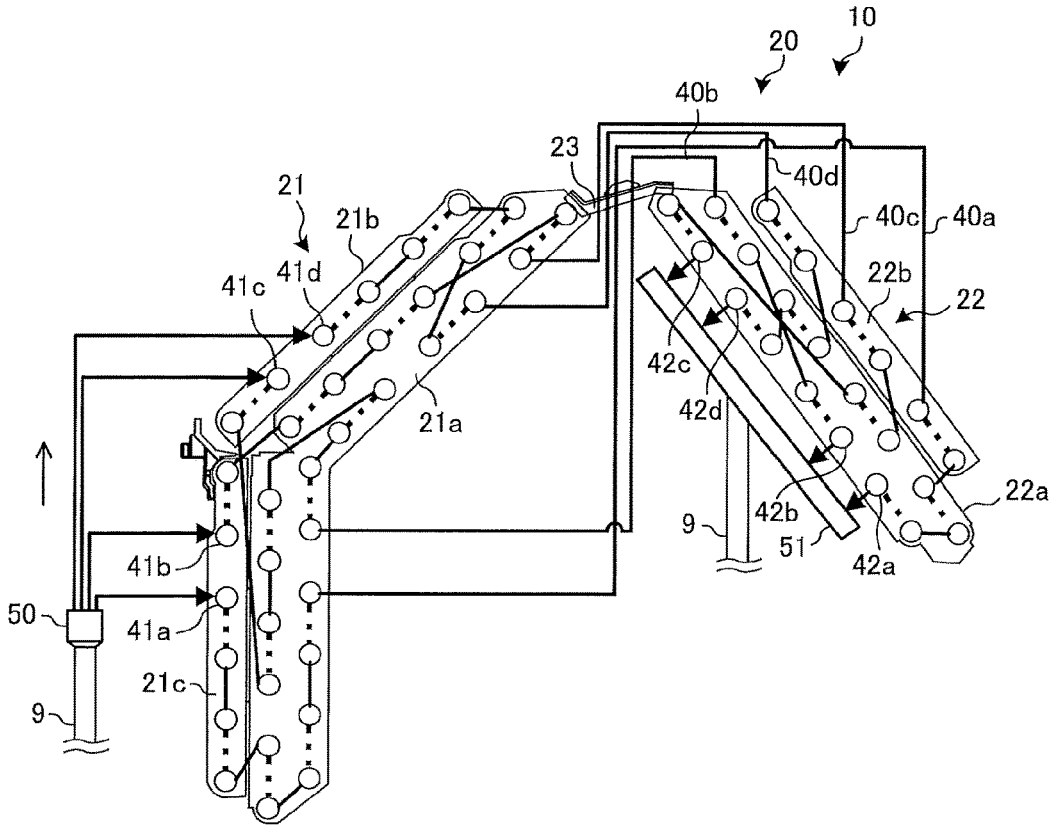
FIG. 8 illustrates four refrigerant passages in the indoor heat exchanger during cooling operation according to Embodiment 3 of the present invention.
Figure 9:
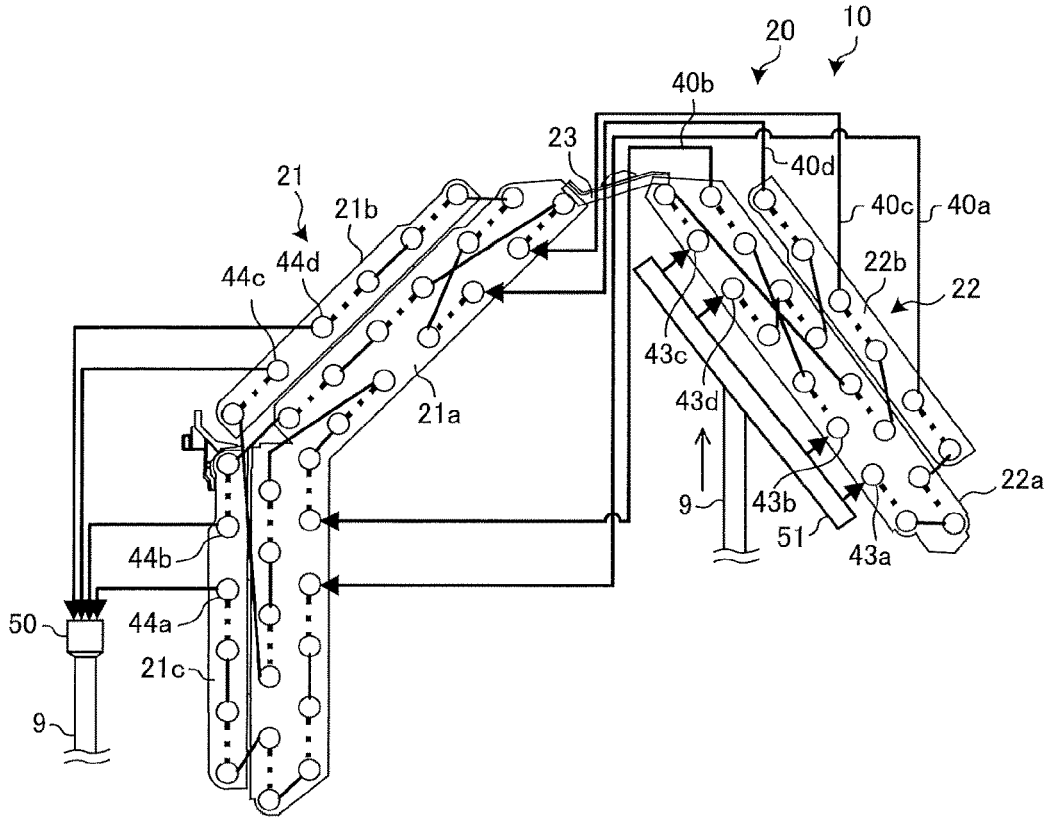
FIG. 9 illustrates four refrigerant passages in the indoor heat exchanger during heating operation according to Embodiment 3 of the present invention.

FIG. 8 illustrates four refrigerant passages 40*a*, 40*b*, 40*c*, and 40*d* in the indoor heat exchanger 20 during cooling operation according to Embodiment 3 of the present invention. FIG. 9 illustrates four refrigerant passages 40*a*, 40*b*, 40*c*, and 40*d* in the indoor heat exchanger 20 during heating operation according to Embodiment 3 of the present invention. Only characteristic features of Embodiment 3 will be described below, and features similar to those of Embodiments 1 and 2 described above will not be described in further detail.

As illustrated in FIGS. 8 and 9, each of the four refrigerant passages 40*a*, 40*b*, 40*c*, and 40*d* is formed as a path extending between the front heat-exchange unit 21 and the rear heat-exchange unit 22. Further, as illustrated in FIG. 8, for each of the four refrigerant passages 40*a*, 40*b*, 40*c*, and 40*d*, the corresponding refrigerant inlet 41*a*, 41*b*, 41*c*, or 41*d* during cooling operation is provided in the front heat-exchange unit 21, and the corresponding refrigerant outlet 42*a*, 42*b*, 42*c*, or 42*d* during cooling operation is provided in the rear heat-exchange unit 22. As illustrated in FIG. 9, for each of the four refrigerant passages 40*a*, 40*b*, 40*c*, and 40*d*, the corresponding refrigerant inlet 43*a*, 43*b*, 43*c*, or 43*d* during heating operation is provided in the rear heat-exchange unit 22, and the corresponding refrigerant outlet 44*a*, 44*b*, 44*c*, or 44*d* during heating operation is provided in the front heat-exchange unit 21. More specifically, for each of the four refrigerant passages 40*a*, 40*b*, 40*c*, or 40*d*, the corresponding refrigerant inlet 41*a*, 41*b*, 41*c*, or 41*d* during cooling operation is provided in one of the two auxiliary front heat-exchange units 21*b* and 21*c*. Further, for each of the four refrigerant passages 40*a*, 40*b*, 40*c*, and 40*d*, the corresponding refrigerant outlet 44*a*, 44*b*, 44*c*, or 44*d* during heating operation is provided in one of the two auxiliary front heat-exchange units 21*b* and 21*c*.

In this regard, the main front heat-exchange unit 21*a*, and each of the auxiliary front heat-exchange units 21*b* and 21*c* are spaced apart from each other. Of the four refrigerant passages 40*a*, 40*b*, 40*c*, and 40*d*, the refrigerant passage 40*a*, which is located in an area where the rate of airflow through the indoor heat exchanger 20 is lowest, has a greater path length than the other refrigerant passages 40*b*, 40*c*, and 40*d*. Each of the four refrigerant passages 40*a*, 40*b*, 40*c*, and 40*d* neither combines with another passage nor splits into branches at any point along the path from the distributor 50 to the combining unit 51. In other words, each of the four refrigerant passages 40*a*, 40*b*, 40*c*, and 40*d* is formed as a single independent passage from the corresponding refrigerant inlet 41*a*, 41*b*, 41*c*, or 41*d* to the corresponding refrigerant outlet 42*a*, 42*b*, 42*c*, or 42*d* of the indoor heat exchanger 20.

More specifically, the refrigerant passage 40*a* is formed by connecting eight heat transfer tubes 25. The refrigerant passage 40*b* is formed by connecting seven heat transfer tubes 25. The refrigerant passage 40*c* is formed by connecting seven heat transfer tubes 25. The refrigerant passage 40*d* is formed by connecting seven heat transfer tubes 25. As described above, for each of the four refrigerant passages 40*a*, 40*b*, 40*c*, or 40*d*, the corresponding refrigerant inlet 41*a*, 41*b*, 41*c*, or 41*d* during cooling operation is provided in one of the two auxiliary front heat-exchange units 21*b* and 21*c*. Further, for each of the four refrigerant passages 40*a*, 40*b*, 40*c*, and 40*d*, the corresponding refrigerant outlet 42*a*, 42*b*, 42*c*, or 42*d* during cooling operation is provided in the main rear heat-exchange unit 22*a*. The refrigerant passage 40*a* has a greater path length than the other refrigerant passages 40*b*, 40*c*, and 40*d*.

<Configuration of Refrigerant Passages 40*a*, 40*b*, 40*c*, 40*d*, and 40*e* According to Modification of Embodiment 3>

Figure 10:
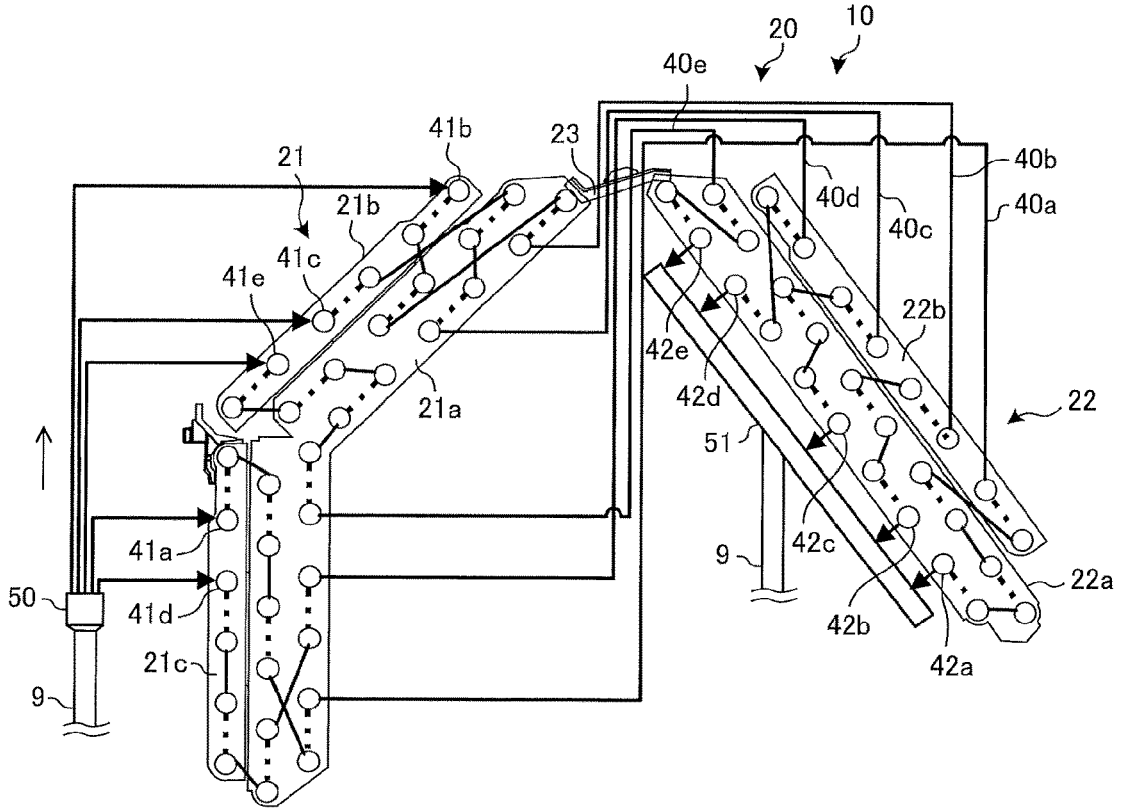
FIG. 10 illustrates five refrigerant passages in the indoor heat exchanger during cooling operation according to a modification of Embodiment 3 of the present invention.

FIG. 10 illustrates five refrigerant passages 40*a*, 40*b*, 40*c*, 40*d*, and 40*e* in the indoor heat exchanger 20 during cooling operation according to a modification of Embodiment 3 of the present invention. Only characteristic features of the modification of Embodiment 3 will be described below, and features similar to those of Embodiment 3 described above will not be described in further detail.

FIG. 10 depicts five refrigerant passages 40*a*, 40*b*, 40*c*, 40*d*, and 40*e*. Each of the five refrigerant passages 40*a*, 40*b*, 40*c*, 40*d*, and 40*e* is formed as a path extending between the front heat-exchange unit 21 and the rear heat-exchange unit 22. Of the five refrigerant passages 40*a*, 40*b*, 40*c*, 40*d*, and 40*e*, the refrigerant passage 40*a*, which is located in an area where the rate of airflow through the indoor heat exchanger 20 is lowest, has a greater path length than the other refrigerant passages 40*b*, 40*c*, 40*d*, and 40*e*. Each of the five refrigerant passages 40*a*, 40*b*, 40*c*, 40*d*, and 40*e* neither combines with another passage nor splits into branches at any point along the path from the distributor 50 to the combining unit 51. In other words, each of the five refrigerant passages 40*a*, 40*b*, 40*c*, 40*d*, and 40*e* is formed as a single independent passage from the corresponding refrigerant inlet 41*a*, 41*b*, 41*c*, 41*d*, or 41*e* to the corresponding refrigerant outlet 42*a*, 42*b*, 42*c*, 42*d*, or 42*e* of the indoor heat exchanger 20.

More specifically, the refrigerant passage 40*a* is formed by connecting eight heat transfer tubes 25. The refrigerant passage 40*b* is formed by connecting six heat transfer tubes 25. The refrigerant passage 40*c* is formed by connecting six heat transfer tubes 25. The refrigerant passage 40*d* is formed by connecting six heat transfer tubes 25. The refrigerant passage 40*e* is formed by connecting six heat transfer tubes 25. Each of the five refrigerant passages 40*a*, 40*b*, 40*c*, 40*d*, and 40*e* is thus formed as a path extending between the front heat-exchange unit 21 and the rear heat-exchange unit 22.

It is to be noted that the same advantageous effects of the present invention as mentioned above can be obtained also for cases where refrigerant is distributed into a number N of refrigerant passages greater than or equal to four as with this modification.

<Advantageous Effects of Embodiment 3>

According to Embodiment 3, the indoor heat exchanger 20 includes the front heat-exchange unit 21. The indoor heat exchanger 20 includes the rear heat-exchange unit 22. Each of the refrigerant passages 40*a*, 40*b*, 40*c*, 40*d*, and 40*e* is formed as a path extending between the front heat-exchange unit 21 and the rear heat-exchange unit 22.

With the above-mentioned configuration, each of the refrigerant passages 40*a*, 40*b*, 40*c*, 40*d*, and 40*e* is formed as a path extending between the front heat-exchange unit 21 and the rear heat-exchange unit 22. In the rear heat-exchange unit 22, the partition unit 31 is provided to separate an end portion of the indoor heat exchanger 20 from the cross-flow fan 7. The flow of air in the rear heat-exchange unit 22 thus needs to be diverted around the partition unit 31, leading to reduced airflow rate and reduced thermal load. At this time, every one of the refrigerant passages 40*a*, 40*b*, 40*c*, 40*d*, and 40*e* passes through the rear heat-exchange unit 22. Therefore, the path lengths of the individual refrigerant passages 40*a*, 40*b*, 40*c*, 40*d*, and 40*e* can be set so as to equalize thermal load in each refrigerant passage. Improved thermal load balance can be thus obtained.

According to Embodiment 3, for each of the refrigerant passages 40*a*, 40*b*, 40*c*, 40*d*, and 40*e*, the corresponding refrigerant inlet 41*a*, 41*b*, 41*c*, 41*d*, or 41*e* during cooling operation is provided in the front heat-exchange unit 21, and the corresponding refrigerant outlet 42*a*, 42*b*, 42*c*, 42*d*, or 42*e* during cooling operation is provided in the rear heat-exchange unit 22.

With the above-mentioned configuration, for each of the refrigerant passages 40*a*, 40*b*, 40*c*, 40*d*, and 40*e*, the corresponding refrigerant inlet 41*a*, 41*b*, 41*c*, 41*d*, or 41*e* during cooling operation is provided in the front heat-exchange unit 21, and the corresponding refrigerant outlet 42*a*, 42*b*, 42*c*, 42*d*, or 42*e* during cooling operation is provided in the rear heat-exchange unit 22. In the rear heat-exchange unit 22, the partition unit 31 is provided to separate an end portion of the indoor heat exchanger 20 from the cross-flow fan 7. The flow of air in the rear heat-exchange unit 22 thus needs to be diverted around the partition unit 31, leading to reduced airflow rate and reduced thermal load. At this time, for every one of the refrigerant passages 40*a*, 40*b*, 40*c*, 40*d*, and 40*e*, the corresponding refrigerant outlet 42*a*, 42*b*, 42*c*, 42*d*, or 42*e* during cooling operation is provided in the rear heat-exchange unit 22. This makes it readily possible to obtain a uniform degree of superheat for the refrigerant at the outlet of each of the refrigerant passages 40*a*, 40*b*, 40*c*, 40*d*, and 40*e*. As a result, for the refrigerant passages 40*a*, 40*b*, 40*c*, 40*d*, and 40*e*, a substantially equal enthalpy can be obtained at each of the corresponding refrigerant outlets 42*a*, 42*b*, 42*c*, 42*d*, and 42*e* of the indoor heat exchanger 20 during cooling operation. The front heat-exchange unit 21 is an area with high airflow rate and large thermal load. In this regard, for every one of the refrigerant passages 40*a*, 40*b*, 40*c*, 40*d*, and 40*e*, the corresponding refrigerant outlet 44*a*, 44*b*, 44*c*, or 44*d* during heating operation is provided in the front heat-exchange unit 21. This makes it readily possible to obtain a uniform degree of sub-cooling for the refrigerant at the outlet of each of the refrigerant passages 40*a*, 40*b*, 40*c*, 40*d*, and 40*e*. As a result, for the refrigerant passages 40*a*, 40*b*, 40*c*, 40*d*, and 40*e*, a substantially equal enthalpy can be obtained at each of the corresponding refrigerant outlets 44*a*, 44*b*, 44*c*, and 44*d* of the indoor heat exchanger 20 during heating operation. Improved thermal load balance can be thus obtained.

Further, for every one of the refrigerant passages 40*a*, 40*b*, 40*c*, 40*d*, and 40*e*, the corresponding refrigerant outlet 42*a*, 42*b*, 42*c*, 42*d*, or 42*e* during cooling operation is provided in the rear heat-exchange unit 22. Consequently, even when cooling operation is performed under slightly insufficient refrigerant flow condition, in the front heat-exchange unit 21, which is located on the upstream side with respect to refrigerant flow in each of the refrigerant passages 40*a*, 40*b*, 40*c*, 40*d*, and 40*e* and where airflow rate is high, sufficient liquid refrigerant flow is supplied, and thus heat exchange is not likely to be affected. As a result, a decrease in cooling capacity can be minimized.

Further, during heating operation, a large uniform degree of super-cooling is obtained at the refrigerant outlets 44*a*, 44*b*, 44*c*, and 44*d* of the front heat-exchange unit 21, which correspond to the refrigerant inlets 41*a*, 41*b*, 41*c*, 41*d*, and 41*e* during cooling operation. Further, the refrigerant inlets 43*a*, 43*b*, 43*c*, and 43*d*, which correspond to the refrigerant outlets 42*a*, 42*b*, 42*c*, 42*d*, and 42*e* during cooling operation, are provided in the rear heat-exchange unit 22. This configuration ensures that during heating operation, in each of the refrigerant passages 40*a*, 40*b*, 40*c*, 40*d*, and 40*e*, condensation of refrigerant occurs over the area between the rear heat-exchange unit 22 and the front heat-exchange unit 21 respectively located on the upstream and downstream sides with respect to refrigerant flow. This makes it readily possible to produce an increased enthalpy difference between the inlet refrigerant and the outlet refrigerant, thus facilitating an improvement in heating capacity.

According to Embodiment 3, the front heat-exchange unit 21 includes the main front heat-exchange unit 21*a*. The front heat-exchange unit 21 includes the auxiliary front heat-exchange units 21*b* and 21*c* positioned upwind of the main front heat-exchange unit 21*a*. For each of the refrigerant passages 40*a*, 40*b*, 40*c*, 40*d*, and 40*e*, the corresponding refrigerant inlet 41*a*, 41*b*, 41*c*, 41*d*, or 41*e* during cooling operation is provided in the auxiliary front heat-exchange unit 21*b* or 21*c*.

The above-mentioned configuration makes it readily possible to obtain a large uniform degree of sub-cooling during heating operation in each of the auxiliary front heat-exchange units 21*b* and 21*c* provided with the refrigerant outlet 44*a*, 44*b*, 44*c*, or 44*d*. This makes it readily possible to produce an increased enthalpy difference between the inlet refrigerant and the outlet refrigerant, thus facilitating an improvement in heating capacity. Further, during heating operation, the main front heat-exchange unit 21*a* with a large heat exchange capacity is located lowermost on the downwind side, and thus sufficient heating of conditioned air is performed.

According to Embodiment 3, the main front heat-exchange unit 21*a*, and each of the auxiliary front heat-exchange units 21*b* and 21*c* are spaced apart from each other.

This configuration makes it possible to block heat and thus prevent heat propagation between the main front heat-exchange unit 21*a* and each of the auxiliary front heat-exchange units 21*b* and 21*c*. This helps prevent deterioration in the efficiency of heat exchange due to heat propagation.

REFERENCE SIGNS LIST

1 compressor 2 four-way valve 3 outdoor heat exchanger 4 expansion valve 6 outdoor fan 7 cross-flow fan 8 outdoor unit 9 refrigerant pipe 10 indoor unit 11 housing 12 design panel 12*a* front casing 12*b* rear casing 13 air inlet 14 top grating 15 air filter 16 front panel 17 air outlet 18 up/down deflector 20 indoor heat exchanger 21 front heat-exchange unit 21*a* main front heat-exchange unit 21*b*, 21*c* auxiliary front heat-exchange unit 22 rear heat-exchange unit 22*a* main rear heat-exchange unit 22*b* auxiliary rear heat-exchange unit 23 partition plate 24 fin heat transfer tube 26*a* U-tube 26*b* fold-back portion 30 drain pan 31 partition unit 32 drain pan 33 partition plate 40*a*, 40*b*, 40*c*, 40*d*, 40*e*, 40*f* refrigerant passage 41*a*, 41*b*, 41*c*, 41*d*, 41*e*, 41*f* refrigerant inlet 42*a*, 42*b*, 42*c*, 42*d*, 42*e*, 42*f* refrigerant outlet 43*a*, 43*b*, 43*c*, 43*d* refrigerant inlet 44*a*, 44*b*, 44*c*, 44*d* refrigerant outlet 50 distributor 51 combining unit 100 air-conditioning apparatus.

The invention claimed is:

1. A heat exchanger in an indoor unit, comprising:

a plurality of fins arranged in parallel; and a plurality of heat transfer tubes that penetrate the fins, wherein the heat transfer tubes define a plurality of refrigerant passages through which refrigerant is passed inside the heat exchanger, wherein each of the refrigerant passages is formed as a single independent passage from a refrigerant inlet to a refrigerant outlet, wherein the heat exchanger has a front heat-exchange unit and a rear heat-exchange unit disconnected from each other, the front heat-exchange unit and the rear heat-exchange unit together forming a chevron shape, an outer periphery portion of the heat exchanger being located on an upwind side of the chevron shape and an inner periphery portion of the heat exchanger being located on a downwind side of the chevron shape, wherein each of the plurality of the refrigerant passages is formed in the front heat-exchange unit and the rear heat-exchange unit as a path extending between the outer periphery portion and the inner periphery portion, wherein the front heat-exchange unit includes a main front heat-exchange unit and an auxiliary front heat-exchange unit, the auxiliary front heat-exchange unit being positioned upwind of the main front heat-exchange unit, wherein each of the refrigerant passages is a passage through the auxiliary front heat-exchange unit, the main front heat-exchange unit, and the rear heat-exchange unit, the refrigerant inlet during cooling operation being provided in the auxiliary front heat-exchange unit, and the refrigerant outlet during cooling operation being provided in the rear heat-exchange unit, and wherein, among the refrigerant passages, a refrigerant passage located in an area of lowest airflow rate has a greater path length than an other refrigerant passage.

2. The heat exchanger of claim 1, wherein a partition unit is provided in an end portion of the heat exchanger to separate the end portion from an area downwind of the end portion, and wherein the refrigerant passage that has the greater path length is located in an area where a flow of air through the area is diverted around by the partition unit and is at its lowest flow rate.

3. The heat exchanger of claim 1, wherein the heat transfer tubes comprise three or more rows of heat transfer tubes disposed between the outer periphery portion and the inner periphery portion to allow heat exchange, and wherein each of the refrigerant passages is formed by connecting two or more heat transfer tubes disposed in each row of the heat transfer tubes.

4. The heat exchanger of claim 1, wherein the main front heat-exchange unit and the auxiliary front heat-exchange unit are spaced apart from each other.

5. The heat exchanger of claim 1, wherein the refrigerant passages comprise four or more refrigerant passages.

6. An indoor unit of an air-conditioning apparatus comprising the heat exchanger of claim 1.

7. An air-conditioning apparatus comprising the indoor unit of an air-conditioning-apparatus of claim 6.

* * * * *